US011763978B2

(12) United States Patent
Yang et al.

(10) Patent No.: US 11,763,978 B2
(45) Date of Patent: Sep. 19, 2023

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Tae Jun Choi, Suwon-si (KR); Byung Soo Kang, Suwon-si (KR); Woo Chui Shin, Suwon-si (KR); Byeong Cheol Moon, Suwon-si (KR)

(73) Assignee: SAMSUNG ELECTRO-MECHANICS CO., LTD, Suwon-si (KR)

( * ) Notice: Subject to any disclaimer, the term of this patent is extended or adjusted under 35 U.S.C. 154(b) by 856 days.

(21) Appl. No.: 16/531,637

(22) Filed: Aug. 5, 2019

(65) Prior Publication Data

US 2020/0303113 A1 Sep. 24, 2020

(30) Foreign Application Priority Data

Mar. 18, 2019 (KR) ..... 10-2019-0030355

(51) Int. Cl.
*H01F 27/28* (2006.01)
*H01F 27/06* (2006.01)
*H01F 27/29* (2006.01)

(52) U.S. Cl.
CPC ..... *H01F 27/28* (2013.01); *H01F 27/06* (2013.01); *H01F 27/29* (2013.01)

(58) Field of Classification Search
USPC ..... 336/192, 200, 232, 198, 83
See application file for complete search history.

(56) References Cited

U.S. PATENT DOCUMENTS

2010/0271162 A1 10/2010 Yan et al.
2014/0002227 A1* 1/2014 Hsieh ..... H01F 5/00 336/200
2014/0265612 A1* 9/2014 Choi ..... H01F 27/366 307/104

(Continued)

FOREIGN PATENT DOCUMENTS

CN 104064319 A 9/2014
CN 108231338 A 6/2018

(Continued)

OTHER PUBLICATIONS

Office Action issued in corresponding Korean Patent Application No. 10-2019-0030355 dated Mar. 13, 2020, with English translation.

(Continued)

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component may include a body having one surface and the other surface facing each other; a wound coil embedded in the body; a first lead frame and a second lead frame, embedded in the body and each having one surface exposed to the one surface of the body to be spaced apart from each other; and a connection portion connecting at least one of the first and second lead frames and at least one end portion of the wound coil.

20 Claims, 3 Drawing Sheets

(56) References Cited

U.S. PATENT DOCUMENTS

| | | | | |
|---|---|---|---|---|
| 2015/0116069 | A1* | 4/2015 | An | H01F 27/2828 29/605 |
| 2016/0351321 | A1* | 12/2016 | Lyoo | H01F 41/041 |
| 2017/0133149 | A1 | 5/2017 | Hsieh et al. | |
| 2017/0229233 | A1 | 8/2017 | Takagi et al. | |
| 2018/0174740 | A1* | 6/2018 | Muneuchi | H01F 27/2828 |
| 2018/0182539 | A1 | 6/2018 | Muneuchi et al. | |
| 2018/0308625 | A1* | 10/2018 | Hasegawa | H01F 17/06 |
| 2019/0198226 | A1* | 6/2019 | Kawamura | H01F 27/2804 |
| 2019/0362873 | A1* | 11/2019 | Arai | H01F 5/04 |
| 2021/0151242 | A1* | 5/2021 | Satou | H01F 27/306 |

FOREIGN PATENT DOCUMENTS

| | | | | |
|---|---|---|---|---|
| JP | 5-36530 | A | | 2/1993 |
| JP | 2010-34102 | A | | 2/2010 |
| JP | 2011003761 | A | * | 1/2011 |
| KR | 10-2017-0023503 | A | | 3/2017 |
| KR | 10-2018-0072568 | A | | 6/2018 |

OTHER PUBLICATIONS

Chinese Office Action dated Feb. 15, 2023, issued in corresponding Chinese Patent Application No. 201911016285.7. with English translation.

* cited by examiner

COIL COMPONENT

CROSS-REFERENCE TO RELATED APPLICATION

This application claims the benefit of priority to Korean Patent Application No. 10-2019-0030355 filed on Mar. 18, 2019 in the Korean Intellectual Property Office, the entire disclosure of which is incorporated herein by reference.

TECHNICAL FIELD

The present disclosure relates to a coil component.

BACKGROUND

Coil components may be generally classified as a laminate type coil component, a wound type coil component, and a thin film type coil component. In the wound type coil component, a metal wire may be wound to form a wound type coil, and the wound type coil may be used as a coil in a component.

Since the wound type coil may be formed by a separate process, as compared with the conventional laminate type coil components and the conventional thin film type coil components, relatively weak coupling force with other constituents of the coil component may occur. As a result, in forming the body of the coil component, the wound type coil may flow and cause defects.

SUMMARY

An aspect of the present disclosure is to provide a coil component having improved coupling force between a wound coil and a lead frame.

Another aspect of the present disclosure is to provide a coil component in which contact resistance (Rdc) may be reduced by relatively increasing an area of a connection portion connecting the wound coil and the lead frame.

According to an aspect of the present disclosure, a coil component includes a body having one surface and the other surface facing each other; a wound coil embedded in the body; a first lead frame and a second lead frame, embedded in the body and each having one surface exposed to the one surface of the body to be spaced apart from each other; and a connection portion connecting at least one of the first and second lead frames and et least one end portion of the wound coil.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
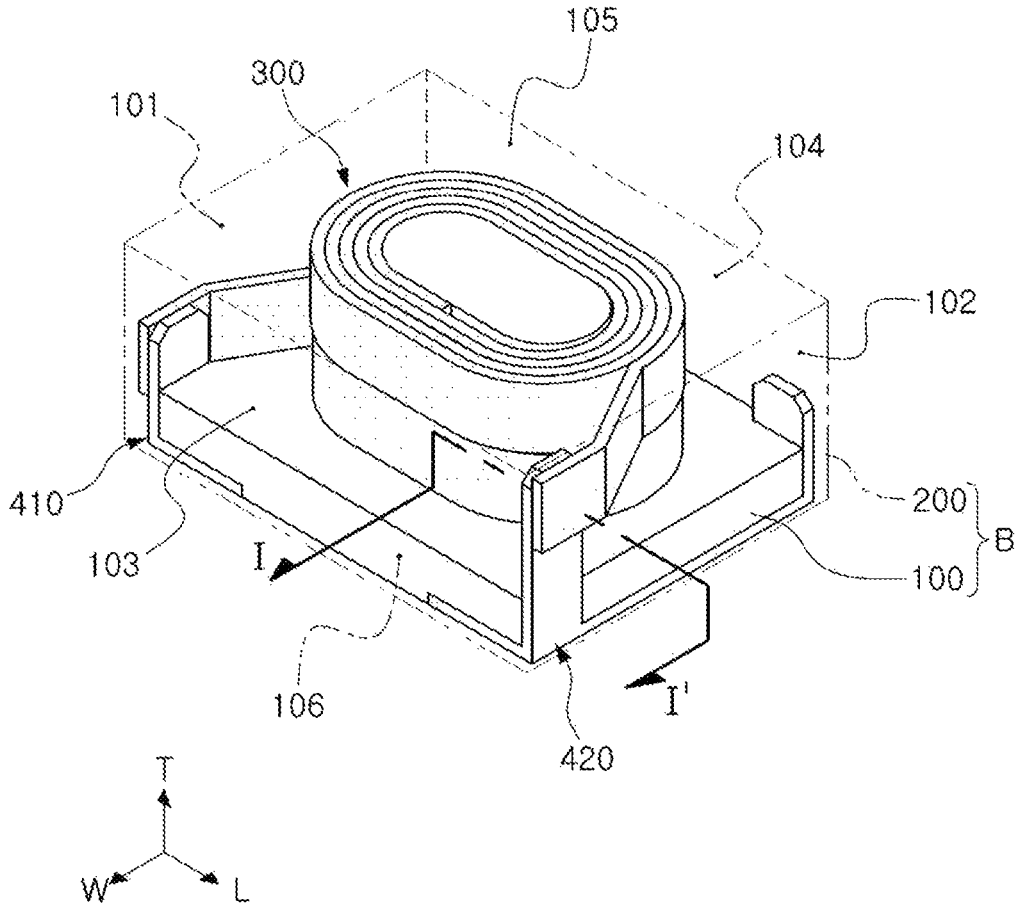
FIG. 1 is a schematic view illustrating a coil component according to an exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length direction, a W direction is a second direction or a width direction, a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Figure 2:
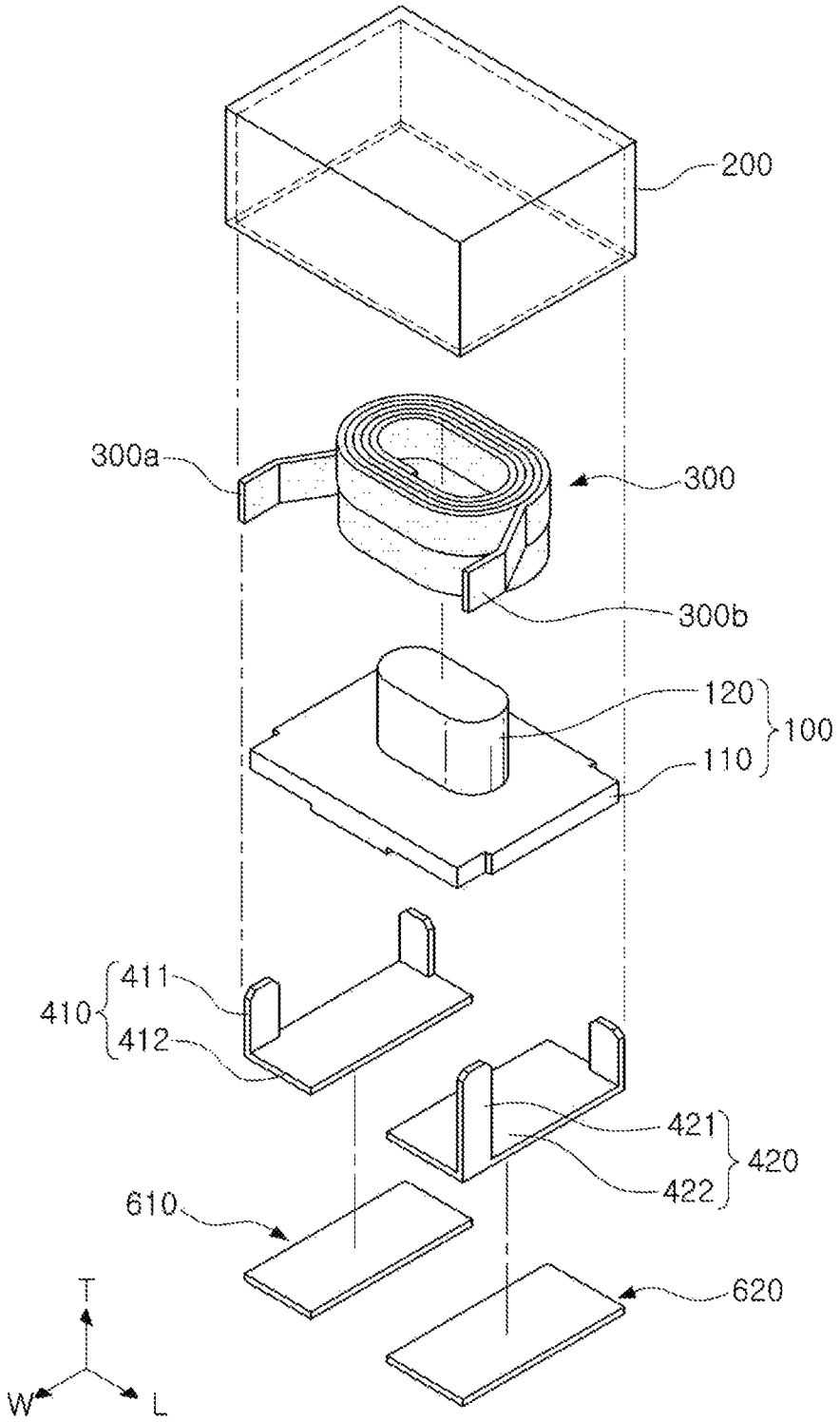
FIG. 2 is a schematic view illustrating a disassembled coil component according to an exemplary embodiment of the present disclosure.

FIG. 1 is a schematic view illustrating a coil component according to an embodiment of the present disclosure. FIG. 2 is a schematic view illustrating a disassembled coil component according to an embodiment of the present disclosure. FIGS. 3 to 6 are schematic views illustrating a cross-section taken along line A-A' in FIG. 1, respectively.

FIGS. 3 to 6 are schematic views illustrating a coupling relationship between end portions of wound coils, lead frames, and connection portions, respectively, and illustrate modifications of the connection portions applied to an embodiment of the present disclosure.

Referring to FIGS. 1 to 6, a coil component 1000 according to an embodiment of the present disclosure may include a body B, a wound coil 300, lead frames 410 and 420, and external electrodes 610 and 620. The body B may include a mold portion 100 and a cover portion 200. The mold portion 100 may include a support portion 110 and a core 120.

The body B may form an exterior of the coil component 1000 according to the present embodiment, and the wound coil 300 may be embedded therein.

The body B may be formed to have a hexahedral shape as a whole.

Referring to FIG. 1, the body B may include a first surface 101 and a second surface 102 facing each other in a longitudinal direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body B may correspond to wall surfaces of the body B connecting the fifth surface 105 and the sixth surface 106 of the body B. Hereinafter, both end surfaces of the body B may refer to the first surface 101 and the second surface 102 of the body B, and both side surfaces of the body B may refer to the third surface 103 and the fourth surface 104 of the body B. Further, one surface of the body B may refer to the sixth surface 106 of the body B, and the other surface of the body B may refer to the fifth surface 105 of the body B.

The body B may be formed such that the coil component 1000 according to the present embodiment in which the external electrodes 610 and 620 to be described later are formed has a length of 2.0 mm, a width of 1.2 mm, and a thickness of 0.65 mm, but is not limited thereto.

The body B may include the mold portion 100 and the cover portion 200. The cover portion 200 may be disposed on the mold portion 100 with reference to FIG. 1 to surround the entire surface, except for a lower surface of the mold portion. The first to fifth surfaces 101, 102, 103, 104, and 105 of the body B may be formed by the cover portion 200, and the sixth surface 106 of the body B may be formed by the mold portion 100 and the cover portion 200.

The mold portion 100 may have one surface and the other surface facing each other, and may include the support portion 110 and the core 120. The support portion 110 may support the wound coil 300. The core 120 may be disposed at a central portion of the one surface of the support portion 110 through the wound coil 300. For the above reason, the one surface and the other surface of the mold portion 100 may be used in the same meaning as the one surface and the other surface of the support portion 110, respectively.

A distance from the one surface to the other surface of the support portion 110, For example, a thickness of the support portion 110, may be 200 μm or more. When the thickness of the support portion 110 is less than 200 μm, it may be difficult to ensure rigidity. A thickness of the core 120 may be 150 μm or more, but is not limited thereto.

Grooves corresponding to the lead frames 410 and 420 to be described later may be formed on the other surface of the support portion 110. The grooves may be formed in the support portion 110 in a pressing and heating process for forming the cover portion 200 to be described later. Alternatively, the groove may be formed by a mold in the process of forming the mold portion 100.

The cover portion 200 may cover the mold portion 100 and a wound coil 300 to be described later. The cover portion 200 may be disposed on the mold portion 100 and the wound coil 300, and may be then pressed to be coupled to the mold portion 100.

At least one of the mold portion 100 and the cover portion 200 may include a magnetic material. In the present embodiment, both the mold portion 100 and the cover portion 200 may include a magnetic material. The mold portion 100 may be formed by filling the magnetic material into a mold for forming the mold portion 100. Alternatively, the mold portion 100 may be formed by filling a composite material containing a magnetic material and an insulating resin into the above-described mold. A molding process in which a high temperature and a high pressure may be applied to the magnetic material or the composite material in the mold may be additionally performed, but is not limited thereto. The support portion 110 and the core 120 may be integrally formed by a mold. The cover portion 200 may be formed of a magnetic composite sheet in which a magnetic material is dispersed in an insulating resin. Specifically, the cover portion 200 may be formed by arranging the magnetic composite sheet on the mold portion 100 and the wound coil 300, and then heating and pressing the magnetic composite sheet.

The magnetic material may be a ferrite powder or a metal magnetic powder.

Examples of the ferrite powder may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder may include at least one of iron (Fe), silicon (Si), chromium (Cr), cobalt (Co), molybdenum (Mo), aluminum (Al), niobium (Nb), copper (Cu), and nickel (Ni), and alloys thereof. For example, the metal magnetic powder may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder may be amorphous or crystalline. For example, the metal magnetic powder may be a Fe—Si—B—Cr-based amorphous alloy powder, but is not limited thereto.

The ferrite powder and the metal magnetic powder may have an average diameter of about 0.1 μm to 30 μm, respectively, but are not limited thereto.

Each of the mold portion 100 and the cover portion 200 may include two or more types of magnetic materials. In this case, the term "different types of magnetic materials" means that magnetic materials dispersed in an insulating resin are distinguished from each other by an average diameter, a composition, crystallinity, and a shape.

The insulating resin may include an epoxy, a polyimide, a liquid crystal polymer, or the like, in a single form or in combined forms, but is not limited thereto.

The wound coil 300 may be embedded in the body B to exhibit the characteristics of the coil component. For example, when the coil component 1000 of the present embodiment is used as a power inductor, the wound coil 300 may store an electric field as a magnetic field such that an output voltage may be maintained, thereby stabilizing power of an electronic device.

The wound coil 300 may be disposed on the one surface of the mold portion 100. Specifically, the wound coil 300 may be disposed on the one surface of the support portion 110, in a wound type with respect to the core 120.

The wound coil 300 may be an air-core coil, and may be composed of a rectangular coil. The wound coil 300 may be formed by spirally winding a metal wire such as a copper (Cu) wire of which surface is coated with an insulating material.

The wound coil 300 may be composed of a plurality of layers. Each layer of the wound coils 300 may be formed in a planar spiral shape, and may have a plurality of turns. For example, the wound coil 300 may form an innermost turn, at least one intermediate turn, and an outermost turn, outward from the central portion of the one surface of the mold portion 100.

The lead frames 410 and 420 may be embedded in the body B, and one surface of each of the lead frames 410 and 420 may be exposed to the one surface of the body to be spaced apart from each other. Specifically, referring to FIGS. 1 and 2, the first lead frame 410 may include a first coupling portion 411 connected to one end portion 300*a* of the wound coil 300, and a first extension portion 412 extending from the first coupling portion 411 to the other surface of the mold portion 100. The second lead frame 420 may include a second coupling portion 421 connected to the other end portion 300*b* of the wound coil 300, and a second extension portion 422 extending from the second coupling portion 421 to the other surface of the mold portion 100. The first and second extension portions 412 and 422 may be spaced apart from each other in the other surface of the mold portion 100 in the longitudinal direction L of the body B, and may be respectively in an extended form in the width direction W of the body B. Each of the first and second coupling portions 411 and 421 may be formed to extend along the side surface of the mold portion 100, to facilitate coupling with both end portions 300*a* and 300*b* of the wound coil 300, and the end portions may be disposed at a position relatively higher than the one surface of the mold portion 100.

The lead frames 410 and 420 may be members for connecting the both end portions 300*a* and 300*b* of the wound coil 300, and first and second external electrodes 610 and 620, disposed to face the sixth surface 106 of the body B, to each other. For example, in this embodiment, the both end portions 300*a* and 300*b* of the wound coil 300 and the first and second external electrodes 610 and 620 may be connected by the lead frames 410 and 420 for the manufacturing process efficiency. The mold portion 100 and the wound coil 300 may be formed in separate processes. Therefore, an operation of processing shapes of the both end portions 300*a* and 300*b* of the wound coil 300 into shapes corresponding to the side surface and the other surface of the mold portion 100 should be added, to lead the both end portions 300*a* and 300*b* of the wound coil 300 out to be spaced apart from each other, on the other surface of the mold portion 100. For example, a copper wire or the like may be wound and processed into an individual form of the wound coil 300, the individual wound coil 300 may be cut, and, then, both end portions 300*a* and 300*b* of the cut individual wound coil 300 should be processed into shapes corresponding to the side surface of the mold portion 100. However, it may be not easy to process the shape of both end portions 300*a* and 300*b* of the wound coil 300 in view of the size and the like of the body B described above. Therefore, the present embodiment is to connect the both end portions 300*a* and 300*b* of the wound coil 300 and the external electrodes 610 and 620 by using the lead frames 410 and 420, which are separate members.

The lead frames 410 and 420 may be formed by processing a metal plate material such as a copper film by a processing method such as punching, or the like. In this case, the coupling portions 411 and 421 and the extension portions 412 and 422 may be integrally formed, no boundary therebetween may occur. Since the scope of the present disclosure is not limited thereto, the coupling portions 411 and 421 and the extension portions 412 and 422 may be formed as separate members, respectively, such that a boundary between them may be formed. The lead frames 410 and 420 may include copper (Cu).

The connection portion 500 may connect the first and second lead frames 410 and 420 and the both end portions 300*a* and 300*b* of the wound coil 300. The connection portion 500 may physically connect the lead frames 410 and 420 and the wound coils 300, formed separately from each other.

Figure 3:
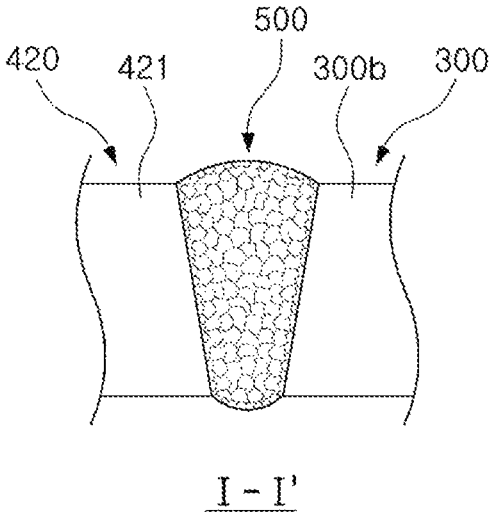
FIGS. 3 to 6 are schematic views illustrating a cross-section taken along line A-A' in FIG. 1, respectively.
Figure 4:
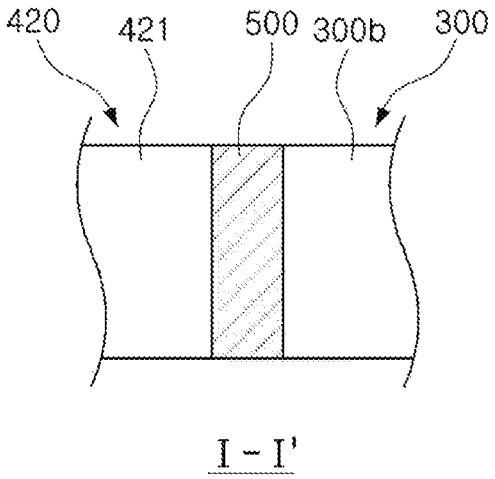
Figure 5:
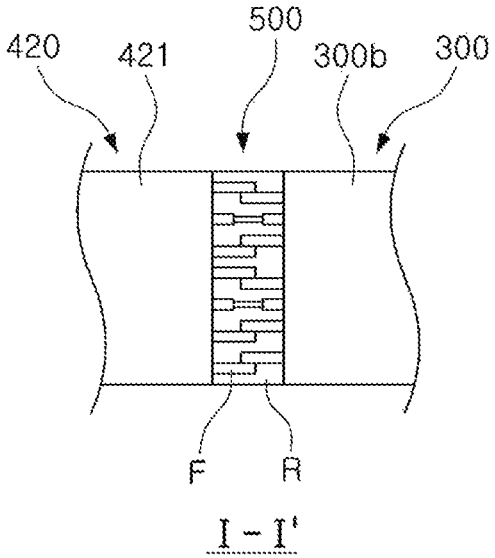
Figure 6:
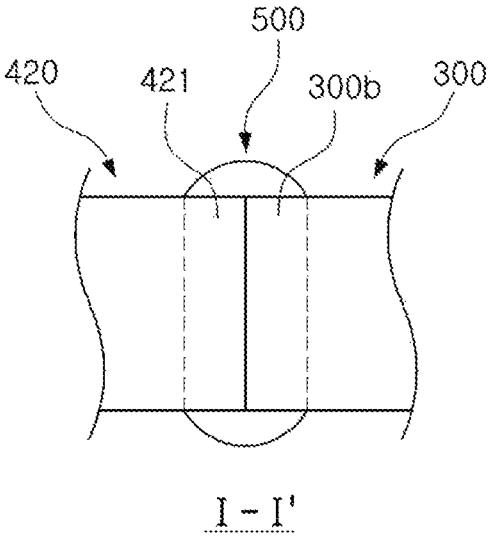

The connection portion 500 may be interposed between the both end portions 300*a* and 300*b* of the wound coil 300 and the lead frames 410 and 420, respectively. For example, as illustrated in FIGS. 3 to 5, a connection portion 500 may be interposed between the other end portion 300*b* of the wound coil 300 and the second lead frame 420. Meanwhile, although not illustrated, the connection portion 500 may be also interposed between the one end portion 300*a* of the wound coil 300 and the first lead frame 410.

A cross-sectional area of a region of the connection portion 500 disposed to face the sixth surface 106 of the body B (a lower portion from the viewpoint of FIG. 3) may be smaller than a cross-sectional area of a region of the connection portion 500 disposed to face the fifth surface 105 of the body B (an upper portion from the viewpoint of FIG. 3). As described above, the cover portion 200 may be formed by disposing the magnetic composite sheet on the mold portion 100 and the wound coil 300, and then pressing and heating the magnetic composite sheet in a direction facing the mold portion 100. The coupling force between the both end portions 300*a* and 300*b* of the wound coil 300, the lead frames 410 and 420, and the connection portion 500 may be weakened due to the pressure in the process. Therefore, although the pressure in the process, the cross-sectional area of the region in which the relatively high pressure is applied in the connection portion 500 (the upper portion from the viewpoint of FIG. 3) may be increased to be larger than the cross-sectional area of the other region (the lower portion from the viewpoint of FIG. 3), to secure the reliability of connection between the both end portions 300*a* and 300*b* of the wound coil 300, the lead frames 410 and 420, and the connection portion 500. The connection portion 500 may be formed such that each of the upper and lower portions of the connection portion 500 include a curved surface. Therefore, the stress applied to the connection portion 500 in the above-described process may be dispersed.

A size of a crystal grain in a region of the connection portion 500 disposed to face the sixth surface 106 of the body B (a lower portion from the viewpoint of FIG. 3) may be smaller than a size of a crystal grain in a region of the connection portion 500 disposed to face the fifth surface 105 of the body B (an upper portion from the viewpoint of FIG. 3). Referring to FIG. 3, the connection portion 500 may be formed by disposing the other end portion 300*b* of the wound coil 300 and the coupling portion 421 of the second lead frame 420 to be in contact with each other, and then performing a laser welding operation in a region contacting the two. In this case, the laser may be irradiated from the upper portion to the lower portion of the above-described contact region, from the viewpoint of FIG. 3. Respective portions of the other end portion 300*b* of the wound coil 300 and the second lead frame 420 of the above-described contact region may be melted by the laser, and then solidified to form the connection portion 500. In the above-described contact region, a difference in energy may arise due to a difference in distance from the laser light source. Therefore, the cross-sectional area of the region of the connection portion 500 disposed to face the sixth surface 106 of the body B (the lower portion from the viewpoint of FIG. 3) may be formed to be smaller than the cross-sectional area of the region of the connection portion 500 disposed to face the fifth surface 105 of the body B (the upper portion from the viewpoint of FIG. 3). In addition, a difference in cooling speed may occur in the connection region 500 in the solidification. Therefore, the size of the crystal grain in the region of the connection portion 500 disposed to face the sixth surface 106 of the body B (the lower portion from the viewpoint of FIG. 3) may be formed to be smaller than the size of the crystal grain in the region of the connection portion 500 disposed to face the fifth surface 105 of the body B (the upper portion from the viewpoint of FIG. 3). The size of the crystal grains may be determined, for example, m by the line intercept method.

Meanwhile, when the connection portion 500 is formed by a laser welding operation as described above, the wound coil 300, the lead frames 410 and 420, and the connection portion 500 may be integrally formed with each other through the above-described melting and solidification. Therefore, the contact resistance may be reduced, as compared with a case in which the both end portions 300*a* and 300*b* of the wound coil 300 and the lead frames 410 and 420 are in contact with each other.

The wound coil 300 and the first and second lead frames 410 and 420 may be formed of the same material, and the connection portion 500 may be formed of a material different from the wound coil 300 and the first and second lead frames 410 and 420. Referring to FIGS. 4 and 5, for example, the wound coil 300 and the second lead frame 420 may be formed of copper (Cu), respectively, and the connection portion 500 disposed between the other end portion 300*b* of the wound coil 300 and the second lead frame 420 may be formed of a conductive material other than copper (Cu). For example, the connection portion 500 may be interposed between the other end portion 300*b* of the coil 300 and the second lead frame 420, and then may be interconnected by a cold pressing operation. For example, the connection portion 500 may be formed of tin (Sn), nickel (Ni), silver (Ag), or the like.

The connection portion 500 may include a resin (R) and a conductive powder (F) dispersed in the resin.

The resin (R) may include an epoxy, a polyimide, a liquid crystal polymer, or the like, in a single form or in combined forms, but is not limited thereto. The conductive powder (F) may be formed of a conductive material such as copper (Cu), aluminum (Al), silver (Ag), tin (Sn), gold (Au), nickel (Ni), lead (Pb), titanium (Ti), or alloys thereof, or may be a non-metallic material such as graphene. The conductive powder (F) may have an anisotropic shape or an anisotropic electric conductivity. For example, a metallic powder in the form of flakes may be used as the conductive powder (F), and a non-metallic powder of graphene having anisotropic electric conductivity may be used.

Each of the first and second lead frames 410 and 420 and the both end portions 300*a* and 300*b* of the wound coil 300 may be in contact with each other, and the connection portion 500 may be formed to cover each of the first and second lead frames 410 and 420 and the both end portions 300*a* and 300*b* of the wound coil 300. For example, referring to FIG. 6, the second lead frame 420 and the other end portion 300*b* of the wound coil 300 may be in contact with each other, and the connection portion 500 may be formed along surfaces of the second lead frame 420 and the other end portion 300*b* of the wound coil 300, to cover the above-described contact region. The connection portion 500 may be formed of solder, and may include tin (Sn). When the connection portion 500 is formed to cover the surfaces of the lead frames 410 and 420 and both end portions 300*a* and 300*b* of the wound coil 300, the connection portion 500 may simply and rapidly connect the lead frames 410 and 420 and the wound coil 300, compared to the above-described examples.

The first and second external electrodes 610 and 620 may be spaced apart from each other on the sixth surface 106 of the body B, for example, be formed on the first and second lead frames 410 and 420, exposed on the other surface of the support portion 110, to be spaced apart from each other on the sixth surface 106 of the body B.

The first and second external electrodes 610 and 620 may have a single-layer structure or a multilayer structure. For example, the first external electrode 300 may include a first layer comprising copper (Cu), a second layer disposed on the first layer and comprising nickel (Ni), and a third layer disposed on the second layer and comprising tin (Sn). The first and second external electrodes 610 and 620 may be formed by an electrolytic plating process, but is not limited thereto.

The first and second external electrodes 610 and 620 may be formed of a conductive material such as copper (Cu), aluminum (Al), silver (Ag), tin (Sn), gold (Au), nickel (Ni), lead (Pb), chromium (Cr), titanium (Ti), or alloys thereof, but is not limited thereto.

Although not illustrated in the drawings, the coil component 1000 according to the present embodiment may further include an insulation layer disposed in a region, except for a region in which the external electrodes 610 and 620 are disposed in the sixth surface 106 of the body B. The insulation layer may be used as a plating resist in forming the external electrodes 610 and 620 by an electrolytic plating process, but is not limited thereto. The insulation layer may also be disposed on at least a portion of the first to fifth surfaces 101, 102, 103, 104, and 105 of the body B.

As one exemplary embodiment of the present disclosure, the would coil 300 may be horizontally disposed in the body B such that an axis of the wound coil 300 is parallel with a direction in which the fifth and sixth surfaces 105, 106 of the body B are facing, as illustrated in FIG. 1.

As another exemplary embodiment of the present disclosure, the would coil 300 may be vertically disposed in the body B such that an axis of the wound coil 300 is perpendicular to a direction in which the fifth and sixth surfaces 105, 106 of the body B are facing, as illustrated in FIG. 7.

According to the present disclosure, the coupling force between the wound coil and the lead frame may be improved and the defect rate may be reduced.

Further, according to the present disclosure, the contact resistance (Rdc) may be reduced by forming the connection area relatively large.

While example embodiments have been shown and described above, it will be apparent to those skilled in the art that modifications and variations could be made without departing from the scope of the present disclosure as defined by the appended claims.

What is claimed is:

1. A coil component comprising:

a body having one surface and the other surface facing each other;

a wound coil embedded in the body;

a first lead frame and a second lead frame, embedded in the body, each having one surface exposed to the one surface of the body, the first and second lead frame being spaced apart from each other; and a connection portion connecting at least one of the first and second lead frames and at least one end portion of the wound coil, wherein a size of a crystal grain in a region of the connection portion facing the one surface of the body is smaller than a size of a crystal grain in a region of the connection portion facing the other surface of the body.

2. The coil component according to claim 1, wherein the connection portion is interposed between the at least one end portion of the wound coil and the at least one of the first and second lead frames.

3. The coil component according to claim 2, wherein a cross-sectional area of a region of the connection portion facing the one surface of the body is smaller than a cross-sectional area of a region of the connection portion facing the other surface of the body.

4. The coil component according to claim 2, wherein a size of a crystal grain of a peripheral region of the connection portion is smaller than a size of a crystal grain of a middle portion thereof.

5. The coil component according to claim 2, wherein each of upper and lower portions of the connection portion include a curved surface.

6. The coil component according to claim 2, wherein the wound coil, the first and second lead frames, and the connection portion each include copper (Cu).

7. The coil component according to claim 1, wherein the connection portion includes any one of tin (Sn), nickel (Ni), or silver (Ag).

8. The coil component according to claim 7, wherein the connection portion comprises a resin and a conductive powder dispersed in the resin.

9. The coil component according to claim 8, wherein the conductive powder is an anisotropic conductive powder.

10. The coil component according to claim 1, wherein the at least one of the first and second lead frames and the at least one end portion of the wound coil are in contact with each other, and the connection portion covers a portion of the at least one of the first and second lead frames and a portion of the at least one end portion of the wound coil.

11. The coil component according to claim 10, wherein the connection portion comprises tin (Sn).

12. The coil component according to claim 1, wherein the body comprises a mold portion and a cover portion disposed on the mold portion, wherein the wound coil is disposed between the mold portion and the cover portion.

13. The coil component according to claim 1, wherein the wound coil is horizontally disposed in the body such that an axis of the wound coil is parallel with a direction in which the one surface and the other surface of the body.

14. The coil component according to claim 1, further comprising a first external electrode and a second external electrode, disposed on the one surface of the body and spaced apart from each other, to be connected to the first and second lead frames, respectively.

15. The coil component according to claim 1, wherein the connection portion is a cold pressed portion.

16. The coil component according to claim 1, wherein the connection portion is disposed between a side surface of the at least one end portion of the wound coil and a side surface of the at least one of the first and second lead frames.

17. The coil component according to claim 1, wherein the first and second lead frames and the wound coil include a same material.

18. The coil component according to claim 1, wherein the connection portion includes a material different from a material of the wound coil and the first and second lead frames.

19. A coil component comprising:

a body having one surface and the other surface facing each other;

a wound coil embedded in the body;

a first lead frame and a second lead frame, embedded in the body, each having one surface exposed to the one surface of the body, the first and second lead frame being spaced apart from each other; and a connection portion connecting at least one of the first and second lead frames and at least one end portion of the wound coil, wherein a size of a crystal grain of a peripheral region of the connection portion is smaller than a size of a crystal grain of a middle portion thereof.

20. The coil component according to claim 19, wherein the connection portion is interposed between the at least one end portion of the wound coil and the at least one of the first and second lead frames.

* * * * *